US005811040A

United States Patent [19]

Mallonee

[11] Patent Number: 5,811,040

[45] **Date of Patent: *Sep. 22, 1998**

[54] PROCESS OF MAKING FIBER FOR CARPET FACE YARN

[76] Inventor: William C. Mallonee, P.O. Box 2318, Dalton, Ga. 30722

[ * ] Notice: The term of this patent shall not extend beyond the expiration date of Pat. No. 5,587,118.

[21] Appl. No.: 787,241

[22] Filed: Jan. 24, 1997

Related U.S. Application Data

[63] Continuation-in-part of Ser. No. 339,336, Nov. 14, 1994, Pat. No. 5,597,650, and Ser. No. 523,470, Sep. 5, 1995, Pat. No. 5,620,797.

[51] Int. Cl.[6] ..... D01F 8/06; D01F 8/12

[52] U.S. Cl. ..... 264/78; 8/497; 8/529; 8/531; 8/637.1; 8/657; 8/658; 8/662; 8/675; 264/103; 264/172.12; 264/172.13; 264/172.17; 264/172.18; 264/210.7; 264/210.8; 264/211.17

[58] Field of Search ..... 264/78, 103, 172.12, 264/172.13, 172.17, 172.18, 210.7, 210.8, 211.17; 8/497, 529, 531, 637.1, 657, 658, 662, 675

[56] References Cited

U.S. PATENT DOCUMENTS

| | | | |
|---|---|---|---|
| 3,047,383 | 7/1962 | Slayter | 419/10 |
| 3,099,067 | 7/1963 | Merriam et al. | 139/420 R |
| 3,137,989 | 6/1964 | Fior et al. | 57/222 |
| 3,220,173 | 11/1965 | Pitzi | 428/397 X |
| 3,312,755 | 4/1967 | Cappuccio et al. | 525/128 |
| 3,331,888 | 7/1967 | Cantatore | 525/184 X |
| 3,359,344 | 12/1967 | Fukushima et al. | 525/184 X |
| 3,361,848 | 1/1968 | Siggel et al. | 525/177 |
| 3,373,222 | 3/1968 | Armstrong | 525/179 |
| 3,419,638 | 12/1968 | Fuzek | 525/177 X |
| 3,431,322 | 3/1969 | Caldwell et al. | 525/173 |
| 3,454,512 | 7/1969 | Ahmed | 525/184 X |
| 3,549,734 | 12/1970 | Yasuda et al. | 525/184 X |
| 3,653,803 | 4/1972 | Hamner | 8/540 |
| 3,900,549 | 8/1975 | Yamane et al. | 264/172.13 |
| 3,937,757 | 2/1976 | Seydl et al. | 525/173 |
| 4,127,696 | 11/1978 | Okamoto | 428/373 |
| 4,174,358 | 11/1979 | Epstein | 525/183 |
| 4,207,404 | 6/1980 | Coran et al. | 525/184 |
| 4,217,427 | 8/1980 | Falk et al. | 525/176 |
| 4,338,413 | 7/1982 | Coran et al. | 525/179 |
| 4,346,194 | 8/1982 | Roura | 525/66 |
| 4,410,661 | 10/1983 | Epstein | 525/66 |
| 4,478,978 | 10/1984 | Roura | 525/66 |
| 4,492,731 | 1/1985 | Bunkar et al. | 428/397 X |
| 4,518,744 | 5/1985 | Brody | 525/184 |
| 4,595,730 | 6/1986 | Blondel et al. | 525/178 |
| 4,663,221 | 5/1987 | Mukimura et al. | 428/397 X |
| 4,757,112 | 7/1988 | Phadke | 525/66 |
| 4,780,505 | 10/1988 | Mashita et al. | 525/66 |
| 4,782,114 | 11/1988 | Perron et al. | 525/66 |
| 4,806,299 | 2/1989 | Burns | 525/184 X |
| 5,108,838 | 4/1992 | Tung | 428/357 |
| 5,445,884 | 8/1995 | Hoyt et al. | 428/370 |
| 5,464,676 | 11/1995 | Hoyt et al. | 428/397 X |
| 5,464,687 | 11/1995 | Sheth | 442/361 |
| 5,468,259 | 11/1995 | Sheth et al. | 8/497 |
| 5,502,160 | 3/1996 | Modrak | 428/359 |
| 5,534,339 | 7/1996 | Stokes | 442/361 |
| 5,587,118 | 12/1996 | Mallonee | 264/78 |

FOREIGN PATENT DOCUMENTS

| | | | |
|---|---|---|---|
| 46-08938 | 3/1971 | Japan | 264/172.13 |
| 50-152019 | 12/1975 | Japan | 264/172.13 |
| 54-30921 | 3/1979 | Japan | 264/172.13 |
| 54-151618 | 11/1979 | Japan | 264/172.13 |

*Primary Examiner*—Leo B. Tentoni
*Attorney, Agent, or Firm*—Luedeka, Neely & Graham P.C.

[57] ABSTRACT

The specification describes a process of making a fiber for a carpet face yarn, the yarn being made of polyolefin/polymer filaments which contain a plurality of longitudinally dispersed relatively small, short polymer fibrils inside the filaments generally concentrated toward the center thereof within the polyolefm matrix. The yarn has the stain resistant properties of polyolefm based yarns and the resiliency of polyamide based yarns at a substantially lower cost than nylon carpet yarns.

28 Claims, 1 Drawing Sheet

PROCESS OF MAKING FIBER FOR CARPET FACE YARN

This application is a continuation-in-part of application Ser. No. 08/339,336 filed Nov. 14, 1994, now U.S. Pat. No. 5,597,650, and a continuation-in-part of application Ser. No. 08/523,470 filed Sep. 5, 1995, now U.S. Pat. No. 5,620,797.

FIELD OF THE INVENTION

The invention relates to a carpet face yarn made of synthetic materials.

BACKGROUND

Carpets, rugs and mats for home and industrial use are typically made from synthetic or natural fibers such as nylon, polyester, polyolefins, acrylics, rayon, cellulose acetate, cotton and wool. Of the foregoing, synthetic fibers tend to be more commercially acceptable and can be used for a wider variety of applications.

Of the synthetic fibers, nylon has been the polymer of choice for carpets. However, nylon is not without its drawbacks. Notably, nylon carpeting is susceptible to developing static electric charges and thus must be chemically or physically treated to reduce the buildup of static charges. Another disadvantage of nylon carpeting is that it will readily stain. Accordingly, nylon carpets usually contain treatments which reduce their staining tendencies. These treatments do not, however, prevent all staining, nor do they last for the life of the carpet.

On the other hand, carpets made from polyolefins, such as polypropylene, are very resistant to staining and are naturally antistatic. However, polypropylene is a less resilient fiber and will not generally maintain its appearance or shape under prolonged or heavy use, or after repeated deformations.

An object of the invention therefore is to provide an improved carpet face filament made of synthetic materials, and a method of making the same.

Another object of the invention is to provide a carpet face filament of the character described having good resiliency with the stain resistance of polyolefins.

Still another object of the invention is provide a method for producing a synthetic carpet face filament which exhibits inherent antistatic properties.

A further object of the invention is to provide a synthetic carpet face filament of the character described which exhibits good dyeability and color fastness.

Yet another object of the invention is to provide a synthetic carpet face filament which is economical to manufacture using conventional filament production processes.

Another object of the invention is to provide a method for dying the synthetic carpet face yarn of the invention.

SUMMARY OF THE INVENTION

With regard to the above and other objects, the invention provides a synthetic carpet face yarn comprising substantially continuous filaments having a size ranging from about 12 to about 25 denier per filament wherein the filaments comprise from about 60 to about 95% by weight polyolefin, preferably polypropylene, as a continuous matrix and from about 5 to about 40% by weight of elongate generally longitudinally dispersed relatively small, short polymer fibrils inside the filaments generally concentrated toward the center thereof within the polyolefin matrix, wherein the polymer fibrils are selected from the group consisting of polyamide and polyester fibrils.

Another aspect of the invention provides a method for making fiber for a carpet face yarn having improved stain resistance and resiliency. The method comprises conducting a mixture comprising from about 5 to about 40% by weight of a fibril-forming polymer selected from the group consisting of polyamide and polyester with from about 60 to about 95% by weight polyolefin through a hot melt extruder to produce a substantially homogeneous molten mixture which is forced at a shear rate within the range of from about 1000 to about 5000 reciprocal seconds through a spinnerette containing a plurality of capillary openings to produce individual filaments, drawing and hot air texturizing the filaments at a temperature ranging from about 120° to about 130° C. to provide drawn and texturized filaments having a denier ranging from about 12 to about 25 and combining the drawn and texturized filaments to provide a synthetic carpet face yarn.

It has been found that filaments made according to the invention have a substantially continuous polyolefin phase and a substantially discontinuous polyamide and/or polyester fibril phase interspersed in the polyolefin phase and concentrated toward the center of the filament which provides in a polyolefin-type carpet yarn what amounts to polyamide- and/or polyester-type properties in terms of resiliency and color fastness, but without the apparent characteristic drawbacks of the material forming the fibrils. That is, the yarn exhibits the excellent anti-staining properties of polyolefins and their favorable flame retardancy and antistatic properties, but does not matt to the degree seen in conventional polyolefin fibers. The yarn is also less costly to produce than many polyamide and polyester filaments, since polypropylene is about 60% cheaper per pound in the current market than polyamide and about 50% cheaper per pound than polyester. In addition to the foregoing properties, the yarn of the invention comprising polyolefin/polyester filaments has a matt finish thus reducing the need for the addition of fillers such as titanium dioxide to decrease the luster of the yarn as is required with conventional polyamide carpet yarns.

DETAILED DESCRIPTION OF THE INVENTION

Figure 1:
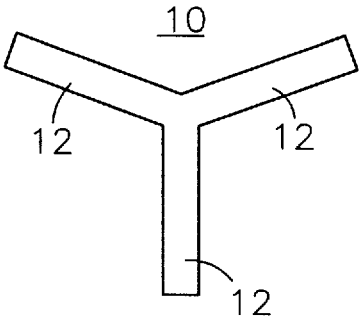
FIG. 1 is an illustration, not to scale, of a preferred spinnerette orifice configuration for producing the synthetic carpet filaments of the invention.

The synthetic carpet yarn of the invention contains from about 60 to about 95% by weight of substantially continuous polyolefin filaments containing from about 5 to about 40% by weight of substantially co-linear, discontinuous polyamide and/or polyester fibrils interspersed in the filaments. Because the polyolefin and fibril-forming polymer are melt blended and forced through capillary openings as a molten blend, each of the resulting filaments contain essentially the same amount of polyolefin and fibril-forming polymer as in the blend.

An important feature of the carpet face yarn of the invention containing polyamide and/or polyester fibrils is that it has the resiliency and flame retardance of polyamide yarns such as nylon 6 and nylon 66, yet has the stain resistance of polyolefin yarns such as polypropylene.

Furthermore, the carpet face yarn of the invention is resistant to the formation of a static electric charge common to polyamide carpet yarns.

The polyolefins which may be used to produce the carpet yarn of the invention include, but are not limited to, polyethylene, polypropylene, poly(1-butene), poly(3-methyl-1-butene), poly(4-methyl-1-pentene), and the like as well as combinations or mixtures of two or more of the foregoing. Of the foregoing polyolefins, polypropylene is particularly preferred. Bulk polypropylene suitable for making the yarn of the invention is available from Shell Chemical Company of Houston, Tex. under the trade name designations NRD5-1263 and 5E70.

The fibril-forming polymer blended with the polyolefin to make the filaments may be selected from the group consisting of polyamide and polyester. Polyamide polymers which may be used include the condensation product of a dibasic acid and a diamine such as adipic acid and hexamethylene diamine (nylon 66), and the addition reaction products of monomers containing both an acid and an amine group in the molecule, such as the polymerization product of e-caprolactam to form polycaproamide (nylon 6). Higher analogs of nylon 6 and 66 may also be used. Of the foregoing, nylon 6 is the most preferred polyamide for use in forming the carpet face yarn of the invention. A suitable source of polyamide is the nylon 6 polymer available from BASF Corporation of Asheville, N.C. under the trade name designation Type 403.

Polyester polymers which may be used to make the yarn of the invention include, but are not limited to, the polycondensation products of dicarboxylic acids or anhydrides with dihydric alcohols and mixtures of the polycondensation products. Dicarboxylic acids and anhydrides which may be reacted with the dihydric alcohols include the saturated or unsaturated fatty acids and anhydrides such as maleic, fumaric, phthalic and adipic acids and anhydrides. A particularly preferred dicarboxylic acid or anhydride is phthalic acid or anhydride.

The dihydric alcohols which are reacted with the dicarboxylic acids or anhydrides to provide the polyester polymers include, but are not limited to, the alkylene glycols having from about 2 to about 10 carbon atoms. Preferred dihydric alcohols include ethylene glycol, propylene glycol, diethylene glycol, and dipropylene glycol. Particularly preferred polycondensation products of dicarboxylic acids or anhydrides and dihydric alcohols include polyethylene terephthalate, polybutylene terephthalate and polypropylene terephthalate.

A suitable source of polyester polymer is the polyethylene terephthalate polymer available from Wellman Corporation of Johnsonville, S.C. under the trade name designation PERMACLEAR PET. Another source of polyester polymer which may be used is polybutylene terephthalate polymer available from BASF Corporation under the trade name ULTRADUR B 4500.

In order to impart flame retardance to the carpet face yarn, one or both of the dicarboxylic acid or anhydride and dihydric alcohols used to make the polyester polymer may be halogenated. Halogens which may be used include chlorine, bromine, and fluorine. Halogenated polyester compounds prepared from the halogenated acids or alcohols may also be mixed with other well known halogenated and non-halogenated flame retardants if desired to further increase the flame retardancy of the carpet face yarn.

It is preferred that the blend of polyolefin and fibril-forming polymer used to make the carpet face yarn contain from about 60 to about 95 wt. %, preferably from about 75 to about 85 wt. % polyolefin and from about 5 to about 40 wt. %, preferably from about 10 to about 20 wt. % fibril-forming polymer.

The polyolefin and fibril-forming polymer may be combined in a variety of ways, however it is preferred to dry blend the components prior to feeding the blend to an extruder. In the alternative, each of the polyolefin and fibril-forming polymer components may be fed directly to the extruder in any order provided there is sufficient residence time in the extruder to assure essentially homogeneous mixing of the two components. It will be recognized that a preblended essentially homogeneous mixture of polyolefin and fibril-forming polymer may also be fed to an extruder.

With respect to a polyester fibril-forming polymer, once combined, the mixture of polyolefin and polyester is melt-blended and extruded under pressure to provide an essentially homogeneous mixture of the two components. Pressures ranging from about 700 to about 2000 psia (about 4.8 MPa to about 13.8 MPa) are preferably used to obtain a homogeneous mixture of the components prior to extrusion.

The molten mixture is forced from the extruder spinnerette at a temperature within the range of 240° to about 300° C. through a plurality of trilobal or delta capillary openings. The extruder temperature used is a function of the viscosity of the fibril-forming polymer in the blend. Where the fibril-forming polymer has a higher viscosity, higher extrusion temperatures should be used. For example, when using nylon 6 the extrusion temperature is preferably in the range of from about 240° to about 280° C. When using polyethylene terephthalate the extrusion temperature is preferably in the range of from about 260° to about 300° C.

Figure 2:
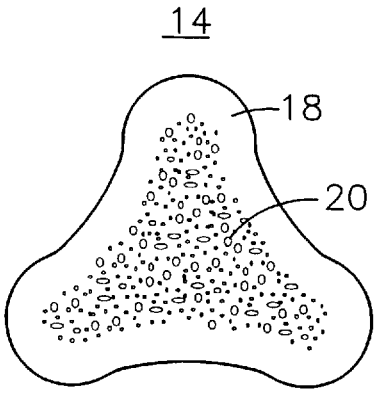
FIGS. 2 and 3 are cross-sectional illustrations, not to scale, of the trilobal or delta filaments of the invention.
Figure 3:
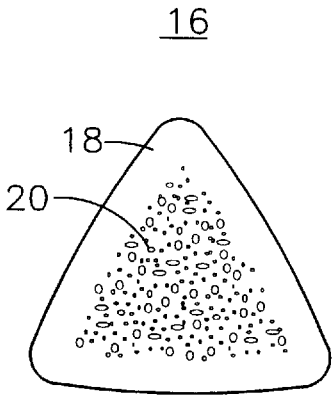

FIG. 1 illustrates a capillary opening 10 for use in producing the filaments of the present invention in a trilobal configuration conventionally used in making carpet yarn. The capillary opening 10 has legs 12 of substantially equal length so that the melted mixture flows through the capillary opening 10 in legs 12 thereby increasing the shear rate on the molten mixture and causing the filament to set in a generally trilobal cross-sectional configuration 14 as illustrated in FIG. 2 or a delta cross-sectional configuration 16 as illustrated in FIG. 3. In FIGS. 2 and 3, the polyolefin 18 provides the bulk of the filament with elongate, longitudinally oriented polyamide or polyester fibrils 20 dispersed within the filament, generally concentrated toward the center of the filament.

The shear rate of the molten mixture during extrusion is an important factor in practicing the present invention for optimal results. Shear rates in the range of from about 1000 to about 5000 reciprocal seconds are preferred. Particularly preferred is a shear rate within the range of from about 2000 to about 4000 reciprocal seconds, with a shear rate of from about 2500 to about 3800 reciprocal seconds being especially preferred. By selecting a plurality of capillary openings of an appropriate size having a trilobal arrangement, the desired shear rate for extrusion of the mixture may be obtained.

After spinning, the filaments are drawn one or more times, preferably three times, and then texturized with either a hot air jet or a steam jet. Unlike other polymeric materials, spinning, drawing and texturizing of the filaments in discrete batch operations are not required. Accordingly, the filaments of the invention may be spun, drawn and texturized essentially continuously without the need for an intermediate curing or a waiting period. In the alternative, an intermediate waiting period may be used between the spinning, drawing and/or texturizing steps.

For purposes of obtaining colored carpet face yarns, the components which are combined to make the yarns of the invention may each contain pigments or chemical dyes, or the finished yarn may be dyed. Useful inorganic pigments include, but are not limited to, cadmium mercury, cadmium mercury orange, cadmium sulfide yellow, cadmium sulfoselenide, titanium dioxide, titanium yellow, titanium green, titanium blue, cobalt aluminate, manganese blue, manganese violet, ultramarine red, ultramarine blue, ultramarine violet, and the like. Organic pigments include, but are not limited to, permanent red 2B, perylene red, quinacridone red, diazo orange, diazo yellow, isoindolinone, hansa yellow, phthalocyanine green, phthalocyanine blue, quinacridone violet, doxazine violet, and the like. Chemical dyes include, but are not limited to, the mono- and disulfonated acid dyes, as well as triphenylmethane, pyrazolone, azine, nitro and quinoline dyes. When used, the pigment dyes may be predispersed in the polyolefin master batch before the polyolefin and fibril-forming polymer are extruded.

Since pure polyolefin filaments cannot generally be dyed with chemical acid or basic dyes, pigment dyes are typically used to give the polyolefin its color in a process known as "solution dyeing". Solution dyeing results in a permanent color that is highly resistant to staining or fading due to UV light. However, in contrast to conventional polyolefin filaments, the filaments of the invention may be dyed with disperse dyes in addition to the pigment dyes, and once dyed, the filaments of the invention have been found to exhibit stain resistant properties similar to pure polyolefin filaments.

When the fibril-forming polymer used with the polyolefin to make the filaments is a polyamide, it is preferred to use a mixture of an acid dye and a disperse dye to dye the filaments. The mixture of dyes may contain from 0 to about 50 percent disperse dye and from about 50 to about 100 percent acid dye. A particularly preferred dye is a mixture of about 50 percent by weight acid dye and about 50 percent by weight disperse dye. When the polymer used is polyester, a disperse dye is preferably used. Disperse dyes are generally used with a carrier fluid which is compatible with the particular dye. Suitable carrier fluids are known to those of ordinary skill in the art. The amount of dye in the carrier fluid used to color the filaments may range from about 0.15 to about 0.7 percent by weight of the dye and carrier fluid, preferably from about 0.2 to about 0.5 percent by weight of the dye and carrier fluid.

In order to dye the filaments, the filaments are preferably first washed with hot water usually containing about 0.5 percent by weight of a base such as NaOH, KOH or $NH_3OH$. The temperature of the hot water wash ranges from about 60° to about 80° C. and should be hot enough to remove any residual finish oils which may be on the filaments.

After washing, the filaments are preferably dyed in a dye bath at about 90° to about 100° C. for about 15 minutes. The dye bath is typically operated at atmospheric pressure. A filament made of a polyolefin/polyester mixture may be dyed using from about 0.2 to about 0.6 percent by weight disperse dye at the same temperature and pressure or at a temperature ranging from about 115° to about 120° C. while maintaining the dye under a slight pressure.

A particular advantage of the carpet yarn made from filaments of the invention is the synergistic flame retardancy of the yarn. Even though the filaments of the yarn may contain only about 15 wt. % non-halogenated fibril-forming polymer and no flame retardants, the yarns according to the invention may exhibit about 45 to about 75% increase in flame retardance relative to the flame retardance of pure polyolefin yarn.

When desired, the polyolefin/polymer filaments of the invention may also contain flame retardants. Flame retardants suitable for use with one or both the components of the filaments include, but are not limited to, brominated polystyrene, hexabromocyclododecane, decabromodiphenyl oxide, ethylene-bis(tetrabromophthalimide), ethylene-bis (dibromonorborane dicarboximide), pentabromodiphenyl oxide, octabromodiphenyl oxide, decabromodiphenoxyethane, poly-dibromophenylene oxide, halogenated phosphate ester, tetrabromophthalic anhydride, bis(tribromophthalic anhydride), tetrabromobisphenol-A bis(2-hydroxyethyl ether), tetrabromobisphenol-A bis(2,3-dibromopropyl ether), dibromo-neopentyl glycol, tetradecabromodiphenoxy benzene, aluminum oxide trihydrated, antimony oxide, sodium antimonate, zinc borate, di-acrylate ester of tetrabromobisphenol-A, and the like.

A preferred flame retardant system will generally contain a halogenated organic compound and a flame retardant synergist such as antimony oxide. The total amount of flame retardant in the yarn may range from about 5 to about 15 wt. % of the total weight of filament. At about 10 wt. % flame retardant, there is often about a 50% increase in flame retardancy as determined by the radiant panel flame retardancy test.

While not desiring to be bound by theoretical considerations, it is believed that the properties of the carpet face yarn of the invention are due, at least in part, to the in-situ formation of elongated, substantially discontinuous polyamide and/or polyester fibrils in a continuous polyolefin phase. The in-situ fibril formation is believed to be promoted by the immiscibility of the components of the mixture with one another, and the shear forces exerted on the molten mixture as it is forced through the capillary openings of the spinnerette.

During extrusion, the forming polymer fibrils concentrate in generally longitudinally aligned orientation toward the center of the capillary openings of the spinnerette where the shear forces are the least. As a result, the elongate fibrils are interspersed in a continuous polyolefin phase which is concentrated near the walls of the capillary openings of the spinnerette where the shear forces are the greatest.

Polyamide and/or polyester fibrils which are produced by the shear forces associated with passage of the material through the capillary openings have a diameter in the range of a fraction of a micron to a few microns and a length of several tens of microns, whereas the overall cross-sectional length of each side of the trilobal or delta filaments containing the fibrils may range from about 1 to about 3 millimeters. Typically, the fibrils will have an average diameter of from about 0.5 to about 5 microns and an average length ranging from about 400 to about 600 microns.

Through a phenomenon not fully understood, the polyolefin forms into a continuous phase providing a matrix encapsulating the polymer fibrils. The polymer fibrils provide reinforcing to the polyolefin matrix similar to reinforcing provided by fiberglass in a thermoplastic or thermoset resin. Accordingly, the polyamide and/or polyester fibrils which are more resilient than the polyolefin improve the resiliency of the yarn over conventional polyolefins making an excellent material for carpet face yarn.

Another factor which is believed to contribute to the formation of fibrils in the center of the filament is the difference in the melt viscosity between the polyolefin and fibril-forming polymer phases. The generally lower polyolefin melt viscosity may cause the polyolefin to flow much more readily through the capillary opening at the walls of the opening where the shear rate is highest while the more viscous fibril-forming polymer concentrates into areas of the capillary opening away from the walls. For example, at a shear rate of 3800 reciprocal seconds, polypropylene has a melt viscosity of 240 poises at 280° C. at the capillary wall. The melt viscosity for the same temperature and shear rate for polyester having an intrinsic viscosity of 0.64 is 2600 poises and is 7800 poises for polyester having an intrinsic viscosity of 0.81 at 280° C. Accordingly, the ratio of fibril-forming polymer melt viscosity to polyolefin melt viscosity is preferably within the range of from about 10:1 to about 40:1 for producing the filaments of the invention containing polyester fibrils in a polyolefin matrix.

At a shear rate of 2500 reciprocal seconds, polypropylene has a melt viscosity of 330 poises at 260° C. at the capillary wall. The melt viscosity for the same temperature and shear rate for nylon 6 having a relative viscosity of 2.4 is 700 poises and is 1160 poises for nylon 6 having a relative viscosity of 2.7. Accordingly, the ratio of fibril-forming polymer melt viscosity to polyolefin melt viscosity is preferably within the range of from about 2:1 to about 3:1 for producing filaments containing polyamide fibrils in a polyolefin matrix.

While it is preferred to utilize polyolefin and fibril-forming polymer without additives other than flame retardants and dyes or pigments, it will be recognized that the carpet face yarn of the invention may contain any one or more additives selected from antioxidants, fillers, antistatic agents, melt processing aids, UV and thermal stabilizers, plasticizers, and the like.

Stabilizers useful with the components used to produce the filaments of the invention include, but are not limited to, calcium powders, calcium stearate, phenols and hindered phenols, zinc oxide, aryl esters, hydroxybenzophenone, hydroxybenzotriazole and the like.

Antioxidants may be selected from alkylated phenols and bisphenols, alkylidene-bisphenols, alkylidene-trisphenols, alkylidene polyphenols, thiophenols, dithio-bisphenols, dithio-trisphenols, thio-polyalkylated phenols, phenol condensation products, amines, dilauryl thiodipropionate, distearyl thiodipropionate, dimyristyl thiodipropionate, ditridecyl thiodipropionate, pentaerythritol tetrakis(β-lauryl thiopropionate), p-benzoquinone, 2,5-ditert-butylhydroquinone, and the like.

Melt processing aids which may be used, particularly when no distributive mixing head is used with the extruder, include maleated polyolefins such as POLYBOND 3200 available from Uniroyal Chemicals of Middlebury, Conn. and EPOLENE E-43 available from Eastman Chemical Company of Kingsport, Tenn. As described above, it is preferred to use a distributive mixing head for mixing the polyolefin and fibril-forming polymer in the extruder.

Various features and aspects of the invention will now be illustrated with reference to the following nonlimiting examples.

In the following examples, an essentially homogeneous mixture of polyester and polyolefin were obtained in a 1.5 inch single screw multizone extruder operating at a pressure of about 1500 psia (about 10.3 MPa) and having a first zone temperature of about 255° C. A preferred method for obtaining a controlled melting of the polymers within a single screw extruder barrel is by the use of a DAVIS STANDARD BARRIER (DSB) mixing screw available from Davis Standard Corporation of Pawcatuck, Conn. as disclosed in U.S. Pat. No. 4,341,474 incorporated herein by reference as if fully set forth. In conjunction with the DSB mixing screw, it is preferred to use a distributive mixing head such as a Union Carbide Corporation (UCC) mixer available from Union Carbide Corporation of Danbury, Conn., or a cavity transfer mixer (CTM) as disclosed in U.S. Pat. Nos. 3,486,192 and 4,419,014 incorporated herein by reference as if fully set forth. A particularly preferred multi-zone extruder for obtaining sufficient control of the temperature in each of the heating zones of the extruder barrel is the THERMATIC single screw extruder available from Davis Standard Corporation as disclosed in U.S. Pat. No. 5,149,193 incorporated herein by reference as if fully set forth.

EXAMPLE 1

A dry blend mixture of 15 wt. % polyethylene terephthalate chips having an intrinsic viscosity of 0.64 from Wellman Corporation of Johnsonville, S.C. and 85 wt. % polypropylene pellets having a melt index of 12 (NRD5-1263 from Shell Chemical Company of Houston, Tex.) were fed from a feed hopper directly into a 1.5 inch hot melt extruder wherein a homogenous molten mixture was obtained. No color concentrate was added to the molten mixture. The molten mixture was then pumped through a pack of screens to remove any particles greater than 20 microns. The screened mixture was pumped to a spinnerette having 72 trilobal capillary openings in order to provide polyolefin/polyester filaments. Each trilobal capillary had leg lengths of 0.0205 inch and leg widths of 0.008 inch. The extrusion rate was 0.278 pound per hour per hole at 280° C. thereby producing a shear rate of 3800 reciprocal seconds. Carpet yarn was spun from the filaments in a two-step process. The spinning was done using polyester extrusion conditions at 300 m/min. The trilobal filaments were spun at a denier of 4500 per 72 filaments (about an average of 62.5 denier per filament) at a melt temperature of 280° C. The yarns were then drawn three times at 115° C. and hot air jet texturized at 130° C. to provide filaments having a denier of 1500 per 72 filaments (about an average of 20.8 denier per filament). The relaxation ratio of the textured yarn was 0.71:1 and the drawn denier was targeted for 1500 denier with 72 filaments (20.8 denier per filament).

EXAMPLE 2

A batch of 100 wt. % nylon 6 chips having a relative viscosity of 2.4 (Type 403 from BASF Corporation of Asheville, N.C.) were fed from a feed hopper directly into a 1.5 inch hot melt extruder. The pure nylon 6 batch was made to obtain a control sample of yarn for comparison of physical properties to the polyester and polypropylene mixtures. No color concentrate was added to the molten mixture. The molten nylon 6 was pumped through a pack of screens to remove any particles greater than 20 microns. The screened nylon 6 was fed to a spinnerette having 72 trilobal capillary openings in order to produce filaments. Each trilobal capillary had leg lengths of 0.0205 inch and leg widths of 0.008 inch. The extrusion rate was 0.278 pound per hour per hole at a temperature of 260° C. thereby producing a shear rate of 3800 reciprocal seconds. Carpet yarns were spun in a one-step process according to the procedure described in Example 1.

EXAMPLE 3

A dry blend mixture of 10 wt. % polyethylene terephthalate chips having an intrinsic viscosity of 0.64 (Wellman Corporation) and 5 wt. % polybutylene terephthalate (ULTRADUR B 4500 from BASF Corporation) and 85 wt. % polypropylene pellets having a melt index of 12 (NRD5-1263 from Shell Chemical Company) were fed from a feed hopper directly into a 1.5 inch hot melt extruder wherein a homogeneous molten mixture was obtained. Processing conditions as described in Example 1 were used to produce a polyolefin/polyester filaments having 1500 denier per 72 filaments (about an average of 20.8 denier per filament).

EXAMPLE 4

A dry blend mixture of 15 wt. % polyester flake having an intrinsic viscosity of 0.81 from Bartex Corporation of Charlotte, N.C. and 85 wt. % polypropylene pellets having a melt index of 12 (NRD5-1263 from Shell Chemical Company) were fed from a feed hopper directly into a 1.5 inch hot melt extruder wherein a homogenous molten mixture was obtained. The polyester flake was obtained from reclaimed polyester bottles. No color concentrate was added to the molten mixture. The molten mixture was then pumped through a pack of screens to remove any particles greater than 20 microns. The screened mixture was pumped to a spinnerette having 72 trilobal capillary openings in order to produce polyolefin/polyester filaments. Each trilobal capillary had leg lengths of 0.0205 inch and leg widths of 0.008 inch. The extrusion rate was 0.278 pound per hour per hole at 280° C. thereby producing a shear rate of 3800 reciprocal seconds. Carpet yarn was spun from the filaments in a two-step process. The spinning was done using polyester extrusion conditions at 300 m/min. The trilobal filaments were spun at a denier of 4500 per 72 filaments (about an average of 62.5 denier per filament) at a temperature of 280° C. The yarns were then drawn three times at 115° C. and hot air jet texturized at 130° C. to produce filaments having a denier of 1500 per 72 filaments (about an average of 20.8 denier per filament). The relaxation ratio of the textured yarn was 0.71:1 and the drawn denier was targeted for 1500 denier per 72 filaments.

For all of the above examples, hot air shrinkage percentages were determined at 140° C. after 10 minutes measured under 0.02 gpd. comparisons of the yarns of Examples 1–4 are given in Table 1.

TABLE 1

| Description | Denier (gms/9000 m) | Tenacity (gpd) | Elongation (%) | Crimp (%) | Shrinkage (%) |
|---|---|---|---|---|---|
| 100 wt. % NRD5-1263 | 1480 | 2.1 | 46 | 2.14 | 14 |
| 100 wt % Nylon 6 | 1517 | 2.3 | 50 | 2.95 | 24 |
| 15 wt. % PET (0.64 IV), 85 wt. % NRD5-1263 | 1488 | 2.5 | 66 | 2.79 | 21 |
| 15 wt. % PET (0.81 IV), 85 wt. % NRD5-1263 | 1530 | 1.8 | 70 | 2.63 | 19 |
| 10 wt. % PET (0.64 IV), 5 wt.% PBT, 85 wt. % NRD5-1263 | 1500 | 2.1 | 92 | 3.03 | 24 |

As compared to polypropylene without polyester reinforcement, the carpet yarn containing polyester fibrils had an increase in elongation, crimp, and fiber shrinkage. Surprisingly, the tenacity, crimp and fiber shrinkage of the polypropylene/polyester yarn were comparable to that of pure nylon yarn, while the elongation of the yarn of the invention was much higher.

In order to test the characteristics of carpet made from the polyolefin/polyester carpet yarn, the 1500 denier filaments were two-ply twisted and heat set. The twisting was 4.50×4.50 tpi and the heat set was done on a SUPERBA stuffer box available from Superba, S.A. of Mulhouse, France at a tunnel temperature of 132° C. To make a carpet from the yarn of the invention the filaments were broadloom tufted in 34 ounce cut pile (⅛ gauge, 9 stitches per inch, 15/32 inch pile height) on a latex substrate with secondary backing. Floor rating, flame retardance, stain rate and static electricity generation were then measured on the carpet yarns of the invention and were compared to 100 wt. % polypropylene and 100 wt. % nylon carpets. The results are given in Table 2.

TABLE 2

| Description | Floor Rating (CRI visual) | Radiant Panel (watts/cm$^2$) | Stain Rate[1] | Floor Static (KV) |
|---|---|---|---|---|
| 100 wt. % NRD5-1263 | 1.8 | 0.22 | 5 | 1.3 |
| 100 wt. % Nylon 6 | 3.0 | 0.63 | 1–2 | 4.1 |
| 15 wt. % PET (0.64 IV), 85 wt. % NRD5-1263 | 2.7 | 0.34 | 4–5 | 1.1 |
| 15 wt. % PET (0.81 IV), 85 wt. % NRD5-1263 | 2.5 | 0.32 | 4–5 | 1.5 |

[1]Stain Rate—American Association of Textile Colorists and Chemists (AATCC) GreyScale method for Staining and color change.

As illustrated by the foregoing samples, the polypropylene/polyester carpets had a floor rating 39 to 50% higher than pure polypropylene carpet even though the yarn contained only 15 wt. % polyester. Likewise, carpet made of filaments according to the invention had a synergistic increase in flame retardancy over that of pure polypropylene in the absence of any added flame retardants as determined by the radiant panel test. Pure polyester carpet typically has a flame retardancy of about 0.45 to about 0.55 watts/cm$^2$. In terms of flame spread, carpet made from the yarn of the invention passed the pill test 8 out of 8 times and the smoke density of the carpet was 300.

The stain rate of the polypropylene/polyester carpet of the invention is comparable to that of pure polypropylene carpet and significantly better than that of pure nylon carpet.

Static electricity generation was evaluated by the AATCC-134 method using neolite soles at 20% relative humidity at 70° F. The maximum threshold limit of static electricity for human comfort is 3.5 kilovolts. None of the carpet samples which were tested were treated for static dissipation using an antistatic finish or antistatic carbon fibers. As illustrated above, the 100 wt. % nylon sample had an unacceptably high static electricity generation, whereas all of the other samples were virtually static electricity free.

Accordingly, polypropylene/polyester (PP/PET) filament yarns containing 15 wt. % PET fibrils according to the invention were significantly better than 100% polypropylene filament yarns (NRD5-1263) in terms of flame retardancy and resiliency and were comparable to the 100% polypropylene filament yarns in terms of static electricity generation. The PP/PET filament yarns were also found to be comparable to the 100% nylon 6 sample yarns in terms of flame retardance and resiliency.

The dyeability of the polyolefin/polyester yarn of the invention as compared to 100 wt. % nylon 6 yarn is illustrated in the following examples. In these samples, yellow, red and blue disperse dyes were used at various concentrations for dyeing the yarns and acid dyes were used for dyeing the 100 wt. % nylon 6 yarns. The dyes and amounts of dyes used for dyeing the yarns are given in Table 3.

TABLE 3

| Sample Description | Sample No. | Dye (wt. %) | Color[1] |
|---|---|---|---|
| 100 wt. % Nylon 6 | A1 | 0.25 | Yellow #199 |
| | A2 | 1.00 | Yellow #199 |
| | A3 | 0.25 | Red |
| | A4 | 1.00 | Red |
| | A5 | 0.25 | Blue #324 |
| | A6 | 1.00 | Blue #324 |
| 15 wt. % PET (0.64 IV), 85 wt. % NRD5-1263 | B1 | 0.25 | Yellow #54 |
| | B2 | 2.00 | Yellow #54 |
| | B3 | 0.25 | Yellow #64 |
| | B4 | 2.00 | Yellow #64 |
| | B5 | 0.25 | Red #60 |
| | B6 | 2.00 | Red #60 |
| | B7 | 0.25 | Blue #87 |
| | B8 | 2.00 | Blue #87 |
| | B9 | 0.25 | Blue #60 |
| | B10 | 2.00 | Blue #60 |
| 15 wt. % PET (0.81 IV), 85 wt. % NRD5-1263 | C1 | 0.25 | Yellow #54 |
| | C2 | 2.00 | Yellow #54 |
| | C3 | 0.25 | Yellow #64 |
| | C4 | 2.00 | Yellow #64 |
| | C5 | 0.25 | Red #60 |
| | C6 | 2.00 | Red #60 |
| | C7 | 0.25 | Blue #87 |
| | C8 | 2.00 | Blue #87 |
| | C9 | 0.25 | Blue #60 |
| | C10 | 2.00 | Blue #60 |
| 10 wt. % PET (0.64 IV), 5 wt. % PBT and 85 wt. % NRD5-1263 | D1 | 0.25 | Yellow #54 |
| | D2 | 2.00 | Yellow #54 |
| | D3 | 0.25 | Yellow #64 |
| | D4 | 2.00 | Yellow #64 |

TABLE 3-continued

| Sample Description | Sample No. | Dye (wt. %) | Color[1] |
|---|---|---|---|
| | D5 | 0.25 | Red #60 |
| | D6 | 2.00 | Red #60 |
| | D7 | 0.25 | Blue #87 |
| | D8 | 2.00 | Blue #87 |
| | D9 | 0.25 | Blue #60 |
| | D10 | 2.00 | Blue #60 |

[1]Color—The acid dyes which were used are available from Crompton & Knowles of Gibralta, Pennsylvania.
[2]Color—The disperse dyes which were used are available from Crompton & Knowles of Gibralta, Pennsylvania.

Analysis of the dyed samples of Table 3, indicated that the polyolefin/polyester yarns of the invention were readily disperse dyeable even without the use of carriers for the dyes. Conventionally, carriers are required in order to obtain deeper dye shades for disperse dyeing of polyester yarns. However, even without the use of carriers, the yarns of the invention obtained acceptable shades for yellow, red and blue disperse dyes.

The color fastness of the dyed yarn samples of Table 3 were compared to the color fastness of 100 wt. % nylon yarn using a cold water bleed test, high humidity (H.H.) ozone fade, $NO_2$ gas fade and 40 hour xenon light fastness tests. The results are given in Table 4 and are based on the AATCC grey scale for staining and color change.

TABLE 4

| | | 107 Cold Water Bleed Test | | | | | | 1 Cycle H.H. Ozone | 1 Cycle $NO_2$ gas | 40 Hrs. Xenon |
|---|---|---|---|---|---|---|---|---|---|---|
| Sample | No. | acetate | cotton | nylon | dacron | orlon | wool | Fade | Fade | Light Fastness |
| 100 wt. % Nylon 6 | 1A | 5 | 5 | 4–5 | 5 | 5 | 5 | 5 | 5 | 5 |
| | 2A | 4–5 | 4–5 | 3–4 | 5 | 5 | 4–5 | 5 | 5 | 5 |
| | 3A | 5 | 5 | 4 | 5 | 5 | 5 | 5 | 5 | 5 |
| | 4A | 5 | 5 | 3 | 5 | 5 | 4 | 5 | 5 | 5 |
| | 5A | 5 | 5 | 4 | 5 | 5 | 4–5 | 5 | 5 | 5 |
| | 6A | 4–5 | 4–5 | 3 | 5 | 5 | 4 | 5 | 5 | 5 |
| 15 wt. % PET (0.64 IV), 85 wt. % PP NRD5-1263 | 1B | 5 | 5 | 5 | 5 | 5 | 5 | 5 | 5 | 5 |
| | 2B | 4–5 | 4–5 | 4–5 | 4–5 | 5 | 4–5 | 5 | 5 | 5 |
| | 3B | 5 | 5 | 5 | 5 | 5 | 5 | 5 | 5 | 5 |
| | 4B | 4 | 4–5 | 4 | 4–5 | 4–5 | 4–5 | 5 | 5 | 5 |
| | 5B | 5 | 5 | 5 | 4 | 5 | 5 | 5 | 5 | 4–5 |
| | 6B | 4–5 | 5 | 4–5 | 5 | 5 | 5 | 5 | 5 | 4–5 |
| | 7B | 5 | 5 | 5 | 5 | 5 | 5 | 5 | 5 | |
| | 8B | 5 | 5 | 4–5 | 5 | 5 | 5 | 5 | 5 | 4–5 |
| | 9B | 5 | 5 | 5 | 5 | 5 | 5 | 5 | 5 | 5 |
| | 10B | 5 | 5 | 5 | 5 | 5 | 5 | 5 | 5 | 5 |
| 15 wt. % PET (0.81 IV), 85 wt. % PP NRD5-1263 | 1C | 5 | 5 | 5 | 5 | 5 | 5 | 5 | 5 | 5 |
| | 2C | 4–5 | 4–5 | 4–5 | 4–5 | 5 | 5 | 5 | 5 | 5 |
| | 3C | 5 | 5 | 5 | 5 | 5 | 5 | 5 | 5 | 5 |
| | 4C | 4 | 4–5 | 4 | 4–5 | 5 | 4–5 | 5 | 5 | 5 |
| | 5C | 5 | 5 | 5 | 5 | 5 | 5 | 5 | 5 | 4 |
| | 6C | 4 | 4–5 | 4 | 4–5 | 5 | 4–5 | 5 | 5 | 5 |
| | 7C | 5 | 5 | 5 | 5 | 5 | 5 | 5 | 5 | 5 |
| | 8C | 4–5 | 5 | 4–5 | 5 | 5 | 5 | 5 | 5 | 5 |
| | 5C | 5 | 5 | 5 | 5 | 5 | 5 | 5 | 5 | 5 |
| | 10C | 5 | 5 | 5 | 5 | 5 | 5 | 5 | 5 | 5 |
| 10 wt. % PET (0.64 IV), 5 wt. % PBT and 85 wt. % PP NRD5-1263 | 1D | 4–5 | 5 | 4–5 | 5 | 5 | 5 | 5 | 5 | 5 |
| | 2D | 4 | 4–5 | 4 | 4–5 | 5 | 4–5 | 5 | 5 | 5 |
| | 3D | 4–5 | 5 | 4–5 | 5 | 5 | 5 | 5 | 5 | 5 |
| | 4D | 4 | 4–5 | 4 | 4–5 | 5 | 4–5 | 5 | 5 | 5 |
| | 5D | 5 | 5 | 5 | 5 | 5 | 5 | 5 | 5 | 4 |
| | 6D | 4–5 | 5 | 4–5 | 5 | 5 | 5 | 5 | 5 | 5 |
| | 7D | 5 | 5 | 5 | 5 | 5 | 5 | 5 | 5 | 5 |
| | 8D | 5 | 5 | 5 | 5 | 5 | 5 | 5 | 5 | 5 |
| | 9D | 5 | 5 | 5 | 5 | 5 | 5 | 5 | 5 | 5 |
| | 10D | 5 | 5 | 5 | 5 | 5 | 5 | 5 | 5 | 5 |

As illustrated by the above examples, the polyolefin/polyester yarns of the invention had equivalent color fastness to nylon 6 and slightly better cold water bleed. The nylon 6 yarns bled on nylon in the cold water bleed test while the yarns of the invention did not bleed on any fabric.

The production of polyester fibrils within the polypropylene phase of the filaments was confined by observation of the filaments under a magnification of 400× using polarized light and the dimensions of the fibrils were assessed. The differences in fibril characteristics between high and low intrinsic viscosity polyester fibrils (Examples 1 and 3, respectively) are shown in the following Tables 5 and 6.

TABLE 5

| Smaller Size Fibrils | Length (L) | Diameter (D) | Ratio (L/D) |
|---|---|---|---|
| Low Viscosity PET (0.64 IV) | 68 | 3.8 | 18 |
| High Viscosity PET (0.81 IV) | 38 | 3.0 | 13 |

TABLE 6

| Larger Size Fibrils | Length (L) | Diameter (D) | Ratio (L/D) |
|---|---|---|---|
| Low Viscosity PET (0.64 IV) | 790 | 2.0 | 395 |
| High Viscosity PET (0.81 IV) | 410 | 1.6 | 256 |

As illustrated in Tables 5 and 6, high viscosity PET (bottle reclaim grade) polyolefin/polyester filaments exhibit a fibril length which is generally about 45% less than that of lower viscosity PET-containing filaments. Likewise the diameters and L/D ratios of the higher viscosity PET-containing filaments are generally lower than that of lower viscosity PET-containing filaments.

The polyolefin/polyester yarns of the invention have a naturally matt finish without the addition of fillers such as titanium dioxide whereas pure nylon face yarns have a shiny finish and require the addition of fillers to reduce the gloss of the carpet fibers. Since there is no need to add fillers to the yarn of the invention production costs for the yarn may be minimized.

EXAMPLE 5

A dry blend mixture of 14 wt. % nylon 6 having a relative viscosity of 2.4 (Type 403 from BASF Corporation) and 86 wt. % polypropylene pellets having a melt index of 12 (5A72 from Shell Chemical Company) were fed from a feed hopper directly into a 2½ inch hot melt extruder wherein a homogenous molten mixture was obtained. A beige polypropylene color concentrate under the trade name BEIGE 182 from Americhem of Cuyahoga Falls, Ohio, was added to the molten mixture for color. The molten mixture was then pumped through a pack of screens to remove any particles greater than 20 microns. The screened mixture was pumped to a spinnerette having a 40 trilobal capillary openings in order to form filaments. Each trilobal capillary had leg lengths of 0.0205 inch and leg widths of 0.008 inch. The extrusion rate was 0.625 pound per hour per hole at 260° C. thereby producing a shear rate of 2450 reciprocal seconds. Carpet yarn was spun from the filaments thus formed in a two-step process. The spinning was done using nylon 6 extrusion conditions at 320 m/min. The delta-shaped filaments were spun at a denier of 2175 per 40 filaments at a temperature of 258° C. The yarns were then drawn three times at 125° C. and hot air jet texturized at 130° C. The drawing was 2 ply to yield a textured, singles yarn having a denier of 1450 per 80 filaments. The relaxation ratio was 0.71:1 and the drawn denier was targeted for 1450 denier with 80 filaments. The physical properties of the two ply yarn are given in the following Table.

TABLE 7

| Description | Denier (gms/9000 m) | Tenacity (gpd) | Elongation (%) | Crimp (%) |
|---|---|---|---|---|
| 100% SA72 | 1470 | 2.45 | 41 | 2.20 |
| 100% PA6 | 1451 | 3.20 | 50 | 3.21 |
| 10% PA6, 90% SA72 | 1463 | 2.49 | 49 | 2.92 |
| 15% PA6, 85% SA72 | 1490 | 2.61 | 45 | 3.15 |

In order to form a suitable carpet face yarn, the 1450 denier polyolefin/nylon (PP/N) filaments are two-ply twisted and heat set. Twisting of the filaments is at 4.50×4.50 tpi and the yarn may be heat set on a SUPERBA stuffer box at a tunnel temperature of 135° C.

Once twisted and heat set, the yarn of the invention may be broadloom tufted in, for example, 34 ounce cut pile having 54 stitches and 15/32 inch pile height. Carpet thus formed from the foregoing fiber exhibits a Carpet Research Institute (CRI) floor rating much better than pure polypropylene yarn and generally comparable to that of pure nylon yarn.

The carpet face yarn of the invention also exhibits an improved flame retardancy as determined, for example, by a Radiant Panel test. The flammability rating of carpet face yarn made from the foregoing PP/N filaments generally have a flammability rating close to that of pure nylon yarn even though the yarn of the invention may contain only about 15 wt. % of nylon.

As compared to polypropylene without nylon reinforcement, the carpet yarn containing nylon fibrils also has an increase in tensile strength and fiber shrinkage. Accordingly, both the 10% and 15% PA6 containing filaments are better than 100% polypropylene (SA72) in terms of flame retardance and resiliency and the 15% PA6 containing filaments have a flame retardancy and a resiliency comparable to that of 100% PA6.

EXAMPLE 6

A carpet face yarn was made using nylon 6 polymer having a relative viscosity of 43 under the trade name BASF-BS400 available from BASF Corporation. The polypropylene was a homopolymer having a number average molecular weight of about 300,000 and a nominal 20 melt flow index under the trade name 5E70 available from Shell Chemical Company. The nylon was dried overnight at 160° F. to a moisture content of 0.05 percent by weight and was melt blended with the polypropylene. The melt blended mixture of nylon and polypropylene was extruded through a 72 hole trilobal spinnerette having leg dimensions of 0.0205 inch long and 0.008 inch wide. The extrusion rate was 0.2756 pound per hour per hole at 262° C.

For comparison purposes, mixtures of nylon and polypropylene were extruded through a 72 hole spinnerette having 0.009 of an inch diameter round holes at 300° to 305° C. and at a rate of 0.1365 pound per hour per hole. The physical characteristics of pure polypropylene yarn and the PP/N6 yarn produced with both the round capillary spinnerette and the trilobal spinnerette are given in the following table.

TABLE 8

| Run No. | Components | Stress at 50% Strain (gpd) | Extension (%) | Breaking Strength (gpd) | Bulk at 120° (%) | Filaments |
|---|---|---|---|---|---|---|
| 1 | 100 wt. % PP[1] | 0.47 | 387 | 1.85 | 6 | 2000 mpm 333 denier |
| 2 | 100 wt. % PP | 1.88 | 50 | 1.90 | 13 | 300 mpm 4500 denier |
| 3 | 94 wt. % PP 6 wt. % N6[2] | 0.82 | 3.25 | 1.60 | 5 | 2000 mpm 333 denier |
| 4 | 94 wt. % PP 6 wt. % N6 | 1.95 | 52 | 1.97 | 20 | 300 mpm 4500 denier |
| 5 | 90 wt. % PP 10 wt. % N6 | 1.89 | 61 | 1.92 | 22 | 300 mpm 4500 denier |
| 6 | 85 wt. % PP 15 wt. % N6 | 1.89 | 50 | 1.91 | 23 | 300 mpm 4500 denier |

[1]PP is polypropylene polymer using the trade name 5E70 available from Shell Chemical Company of Houston, Texas, having a number average molecular weight of about 300,000 and a nominal 20 melt flow index.
[2]N6 is nylon 6 polymer having a relative viscosity of 43 available from BASF Corporation of Asheville, North Carolina.

In the foregoing example, runs 1 and 2 were conducted with 100 percent polypropylene. The polypropylene and PP/N6 filaments of runs 1 and 3 were made using the 0.009 inch round capillary holes at a temperature of 300°–305° C. at an extrusion rate of 0.1365 pound per hour. The polypropylene and PP/N6 filaments of runs 2, 4, 5 and 6 were made using the trilobal spinnerette at a temperature of 262° C. and an extrusion rate of 0.2756 pound per hour per hole.

As shown in the foregoing table, the PP/N6 yarn made according to the invention exhibited substantially more bulk than either pure polypropylene yarn or the yarn made in Run 3 using round capillary openings and a higher temperature. Photomicrographs of cross-sections of the filaments of run 3 exhibited no evidence of the formation of microfibrils of nylon in the polypropylene phase when magnified 400 times under polarized light at 45°. In contrast, photomicrographs made of cross-sections of the filaments of run 5 showed the presence of microfibrils of nylon embedded in the polypropylene phase under the same magnification. Longitudinal photomicrographs of the filaments of run 5 magnified 100 times and 400 times also showed the presence of microfibrils embedded in the polypropylene phase whereas there was an absence of microfibrils in the filaments of run 3 as determined by longitudinal photomicrographs of the filaments.

Dyeability tests were also conducted on the yarns of runs 3 and 4. Disperse Blue #60 dye was used to dye the yarn of runs 3 and 4. The yarn of run 3 dyed nonuniformly as compared to the yarn of run 4 containing the same amount of nylon.

Having described and illustrated preferred embodiments of the invention, it will be appreciated that various modifications, rearrangements and substitutions made to the invention by those of ordinary skill are within the spirit and scope of the appended claims.

What I claim is:

1. A method for making fiber for a synthetic carpet face yarn having improved stain resistance and resiliency comprising conducting a mixture which includes from about 5 to about 40 wt. % of a polymer selected from the group consisting of polyamide and polyester and from about 60 to about 95 wt. % polyolefin through a hot melt extruder to produce an essentially homogeneous molten mixture thereof, forcing the molten mixture at a shear rate within the range of from about 1000 to about 5000 reciprocal seconds through a spinnerette containing a plurality of capillary openings to produce individual filaments, drawing and hot air texturizing the filaments at a temperature ranging from about 120° to about 130° C. to provide drawn and texturized filaments having a denier ranging from about 12 to about 25 and combining the drawn and texturized filaments to provide a synthetic carpet face yarn.

2. The method of claim 1 wherein the polyolefin is polypropylene.

3. The method of claim 1 wherein the polymer is selected from the group consisting of polyethylene terephthalate, polybutylene terephthalate and mixtures thereof.

4. The method of claim 3 wherein the polymer is polyethylene terephthalate and the mixture is heated in the extruder at a temperature within the range of from about 260° to about 300° C.

5. The method of claim 1 wherein the polymer comprises polybutylene terephthalate.

6. The method of claim 1 wherein the polymer comprises polyethylene terephthalate.

7. The method of claim 1 wherein the polymer comprises a mixture of polyethylene terephthalate and polybutylene terephthalate.

8. The method of claim 1 wherein the polymer comprises nylon.

9. The method of claim 1 wherein the mixture comprises from about 10 to about 15 wt. % polymer and from about 85 to about 90 wt. % polyolefin.

10. The method of claim 1 wherein the shear rate is within the range of from about 2000 to about 4000 reciprocal seconds.

11. The method of claim 1 wherein the capillary openings comprise trilobal capillary openings having leg lengths of 0.0205 inch and leg widths of 0.008 inch.

12. The method of claim 1 wherein the polymer comprises nylon, and the method further comprises dying the yarn with a dye selected from the group consisting of a acid dye and a mixture of disperse and acid dyes.

13. A method for making fiber for a carpet face yarn having improved stain resistance and resiliency which comprises preblending from about 5 to about 40 wt. % of a polymer selected from the group consisting of polyamides and polyesters with from about 60 to about 95 wt. % polyolefin to provide a polymer/polyolefin blend; conducting the blend through a hot melt extruder to produce an essentially homogeneous molten mixture thereof; and forcing the molten mixture at a shear rate within the range of from about 1000 to about 5000 reciprocal seconds through a spinnerette containing a plurality of trilobal or delta capillary openings to produce individual filaments wherein the filaments comprise a substantially continuous polyolefin phase and a substantially discontinuous polymer phase interspersed in the polyolefin phase, the polymer phase comprising relatively small, short longitudinally oriented fibrils concentrated generally toward the center of the filaments in the polyolefin phase, drawing the filaments to a denier of from about 12 to about 25, hot air texturizing the filaments at a temperature ranging from about 120° to about 130° C., and combining the filaments to provide a carpet face yarn.

14. The method of claim 13 wherein the polyolefin comprises polypropylene.

15. The method of claim 13 wherein the polymer is selected from the group consisting of polyethylene terephthalate, polybutylene terephthalate and mixtures thereof.

16. The method of claim 15 wherein the polymer comprises polyethylene terephthalate and the blend is heated in the extruder to a temperature within the range of from about 220° to about 300° C.

17. The method of claim 13 wherein the polymer comprises polybutylene terephthalate.

18. The method of claim 13 wherein the polymer comprises polyethylene terephthalate.

19. The method of claim 13 wherein the polymer comprises a mixture of polyethylene terephthalate and polybutylene terephthalate.

20. The method of claim 13 wherein the polymer comprises nylon.

21. The method of claim 13 wherein the blend comprises from about 10 to about 15 wt. % polymer and from about 85 to about 90 wt. % polyolefin.

22. The method of claim 13 wherein the shear rate is within the range of from about 2000 to about 4000 reciprocal seconds.

23. The method of claim 13 wherein the capillary openings comprise trilobal capillary openings having leg lengths of 0.0205 inch and leg widths of 0.008 inch.

24. The method of claim 13 wherein the polymer comprises nylon, and the method further comprises dying the yarn with a dye selected from the group consisting of a acid dye and a mixture of disperse and acid dyes.

25. The method of claim 1 wherein the mixture further includes a melt processing aid.

26. The method of claim 25 wherein the melt processing aid is a maleated polyolefin.

27. The method of claim 13 wherein the mixture further includes a melt processing aid.

28. The method of claim 27 wherein the melt processing aid is a maleated polyolefin.

* * * * *

UNITED STATES PATENT AND TRADEMARK OFFICE

CERTIFICATE OF CORRECTION

PATENT NO. : 5,811,040
DATED : September 22, 1998
INVENTOR(S) : William C. Mallonee It is certified that error appears in the above-identified patent and that said Letters Patent is hereby corrected as shown below:

IN THE ABSTRACT: lines 6 and 7, change "polyolefm" to -- polyolefin --.

Column 12, Table 4, line 16, under the column "Light Fastness" insert --5--.

Column 13, line 7, change "confined" to -- confirmed --.

Signed and Sealed this

Sixteenth Day of March, 1999

*Attest:*

Q. TODD DICKINSON

*Attesting Officer*

*Acting Commissioner of Patents and Trademarks*